US005911255A

United States Patent [19]

Bond

[11] Patent Number: 5,911,255

[45] Date of Patent: Jun. 15, 1999

[54] PIPE CLEANING METHOD AND DEVICE

[75] Inventor: Anthony Hugh Bond, Rodbourne, United Kingdom

[73] Assignee: WRc p.l.c., Buckinghamshire, United Kingdom

[21] Appl. No.: 08/638,348

[22] Filed: Apr. 26, 1996

[30] Foreign Application Priority Data

Apr. 28, 1995 [GB] United Kingdom ..... 9508641

[51] Int. Cl.[6] ..... B08B 9/04

[52] U.S. Cl. ..... 15/3.52; 134/22.11

[58] Field of Search ..... 15/104.061, 3.5, 15/3.51, 3.52; 134/22.1, 22.12, 8, 34

[56] References Cited

U.S. PATENT DOCUMENTS 3,879,790 4/1975 Girard ..... 15/104.06
4,244,073 1/1981 Sagawa ..... 15/104.06
4,429,428 2/1984 Van Dyk ..... 15/3.52
5,150,493 9/1992 Sivaroe ..... 15/104.061
5,300,152 4/1994 Lowther ..... 134/8

FOREIGN PATENT DOCUMENTS 9408105 4/1994 WIPO .

*Primary Examiner*—Scott W. Houtteman
*Attorney, Agent, or Firm*—Royston, Rayzor, Vickery, Novak & Druce, L.L.P.

[57] ABSTRACT

A method of cleaning deposits from the inside of a pipe, comprising flushing a liquid through the pipe, and locally increasing the liquid flow rate adjacent the pipe wall.

10 Claims, 1 Drawing Sheet

PIPE CLEANING METHOD AND DEVICE

Figure 1:
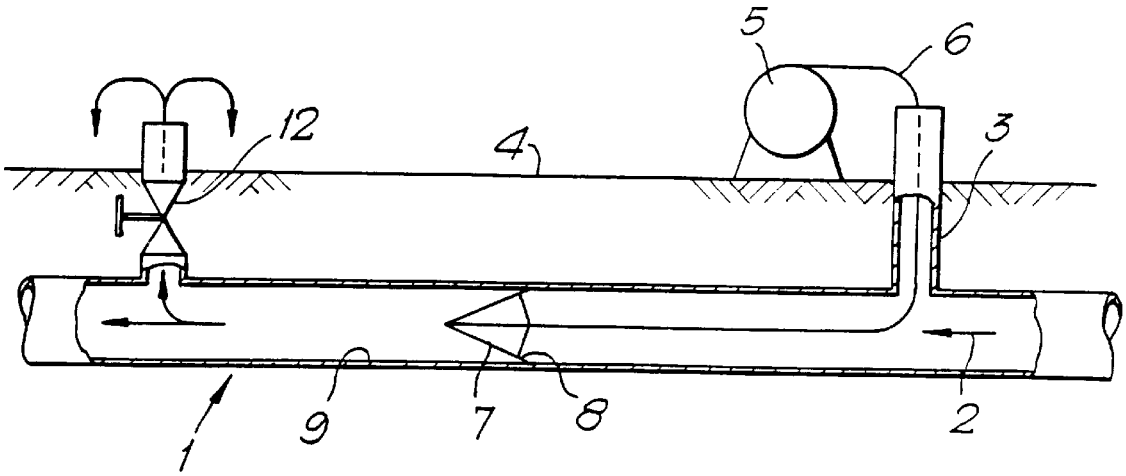

This invention relates to a method and device for cleaning deposits from the insides of pipes.

There are currently a number of techniques used to clean deposits from water mains. These range from flushing, in which a high volume flow is used to dislodge and transport the deposits, to high pressure jetting which requires a jet of water to dislodge the deposits.

The widely used technique of flushing is limited in its effectiveness by the nature of water flow in pipes. The main body of the flow passes down the centre of the pipe with a greatly reduced flow velocity near the pipe walls. As a result, large quantities of water are needed to dislodge deposits from the pipe walls, and the technique is not always very effective.

We have now found a way of modifying the technique of flushing to make it more effective.

According to a preferred feature of the present invention, the inside of a pipe is cleaned by flushing by locally increasing the water flow rate adjacent the pipe wall. In this way, the cleaning effect can be greatly increased.

There are various ways in which the invention can be put into practice. In one preferred embodiment, we provide a body locally in the region of the pipe to be cleaned, whereby the water (or other liquid) flow in the pipe is forced radially outwardly by the body, to pass between the body and the pipe wall, thus increasing the water flow rate adjacent the pipe wall.

Preferably, the body is generally centred on the pipe axis. The body can be mounted to be substantially out of touch of the pipe wall, or preferably it can contact, and most preferably seal against, the pipe wall provided that one or more water flow passages are present to enable the water to flow past the body and at an increased rate adjacent the pipe wall. By sealing the body against the pipe wall, the flow of water through the passages can be kept uniform around the body.

Means are provided to hold the body in the pipe against the flow of water. There are various ways in which this can be done. One preferred method is to tether the body to a point located outside the body and to pay out the tether to allow the body to move along the pipe at the desired rate.

The body may be tethered to any means which permits the tether to be unwound to allow the body to move along the pipe. The unwinding means is preferably a winch. The tether may be any suitable cable or rope and may be made of any suitable material, such as metal or plastic or a natural material.

The body may be resiliently deformable to allow it to be placed in the pipe through an opening smaller than the pipe. Biasing means may be provided to cause the body to expand radially after it has been passed through the smaller opening and into the pipe.

The invention also includes a device for use in the method, which comprises a body for location in a pipe to provide increased fluid flow between the body and the pipe wall, and means for holding the body against the fluid flow.

In the method of the invention, location of the body in the pipe causes a blockage in the centre of the pipe and thus ensures that the main liquid flow is forced closer to the pipe walls. Also, tethering (or otherwise holding) the body ensures that there is a differential pressure built up across the body, this differential pressure causing a high velocity flow past the body increasing the effectiveness of the cleaning.

Figure 2:
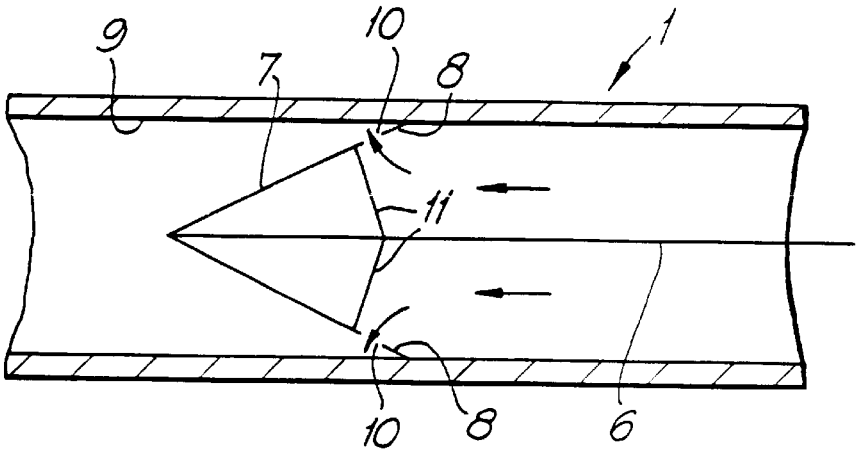

In order that the invention may be more fully understood, embodiments thereof will now be described, by way of illustration only, with reference to the accompanying drawings, in which:

FIG. 1 is a schematic illustration of a pipe being cleaned using the method; and FIG. 2 is a schematic view of an embodiment of cleaning head in the pipe of FIG. 1.

Referring to the drawings, there is shown a water main 1 through which water is flowed in the direction of arrow 2. A small diameter tapping 3 is provided to main 1, the tapping 3 extending to ground level 4. A winch 5 has a supply of wire 6 thereon which extends through tapping 3 into main 1, where it is connected to body 7. Body 7 is a flexible cone with a dependent skirt 8. Skirt 8 bears against the inside wall 9 of main 1. In skirt 8 are a number of openings 10 to permit water to flow therethrough adjacent the wall 9.

Cone 7 is radially inwardly collapsible to permit it to be passed down tapping 3 into main 1. Biasing means may be provided to cause the cone to expand radially outwardly in the main 1. The upstream faces 11 of cone 7 are angled to direct the water flow impinging thereon radially outwardly through openings 10 to bear on the wall 9 to effect cleaning.

Downstream of cone 7, a hydrant 12 can be provided to permit the cleaning water to escape from the main 1 with any debris therein.

In operation, the body 7 is installed in the main 1. Differential pressure across the body 7 will cause it to move in the direction 2 of the main flow of water in the main 1. Once the wire tether 6 becomes taut, the body is prevented from moving further along the main until the tether 6 is paid out from the winch 5. Thus, the body 7 is located and held against the water flow. Pay out of the wire tether 6 allows the body 7 to travel in the water flow direction 2.

The presence of body 7 in main 1 effectively provides a blockage to the central water flow. It need not be a complete block, but it is sufficient to deflect water radially outwardly so as to increase the water flow at the wall 9 relative to the water flow at the wall upstream of the body 7. The effect of this is to increase the cleaning efficiency of the water flush. If desired, a scouring or other turbulent water flow can be induced at the wall 9.

Due to the nature of certain pipes, for example water mains, the body 7 should preferably be able to adapt its shape to the uneven inner surface of wall 9 of the pipe. Thus, when body 7 is a flexible cone, it preferably forms a loose seal inside the pipe, and is preferably able to accommodate local wall surface variations.

The effectiveness of the cleaning may be increased by raising the pressure on the upstream side of the body 7, for example by means of a pump connected to the pipe being cleaned.

In accordance with the invention, the body can be of any shape provided it functions to increase the water flow adjacent the wall. Thus, while a cone shape has been described, this is only one example. Other shapes are possible, e.g., spherical, etc.

I claim:

1. A method of cleaning pipe deposits from the inside of a pipe, comprising:

flushing a liquid through the pipe, positioning a body within the pipe and permitting the body to be moved by the flushing liquid in the forward direction of the flow of the flushing liquid;

controlling forward motion of the body by restraining the body with a tether anchored at a position upstream of the body thereby locally increasing the liquid flow rate adjacent to the pipe wall and about the body; and redirecting fluid flow at the body from a direction substantially parallel with the pipe into radial directions away from the body.

2. A method according to claim 1, wherein the body is in contact with the pipe wall, and a plurality of flow passages are positioned about a periphery of the body to enable the liquid to flow past the body at an increased rate adjacent to the pipe wall.

3. A method according to claim 2, wherein a portion of said body adjacent to said flow passages forms a seal against the pipe wall, thereby substantially limiting liquid flow past said body to said passages.

4. A method according to claim 1, wherein the tether is anchored to a winch.

5. A method according to claim 1, wherein the body is radially inwardly collapsible, whereby the body can be introduced into the pipe through an opening smaller than the pipe, and wherein the body is radially outwardly biased, whereby the body can expand to the size of a pipe substantially larger than the opening of the pipe after introduction into the pipe.

6. A method according to claim 1, further comprising increasing the pressure upstream of the body.

7. A method according to claim 6, wherein the pressure is increased with a pump.

8. A method according to claim 1, wherein the body is a substantially hollow cone.

9. A method according to claim 8, wherein the tip of the cone is arranged downstream of the base of the cone.

10. A device for use in cleaning deposits from the inside of a pipe, said device comprising:

a body in the shape of a hollow cone adapted for location in the pipe for restricting liquid flow through the pipe, said body being radially inwardly collapsible against a radially outwardly bias such that said body may be introduced into the pipe through an opening substantially smaller in diameter than the diameter of the pipe and thereafter expand to substantially the diameter of the pipe;

said body being further adapted for forcing liquid flow radially outward from the body toward an area adjacent the pipe wall;

a plurality of flow passages positioned substantially radially about said body and adjacent the pipe wall for allowing a substantial flow of the radially outwardly forced liquid past said body;

a tether for adjustably holding said body in position against the liquid flow through the pipe, thereby increasing the flow rate of liquid through said passages; and a winch for paying out said tether to allow said body to pass through the pipe at a rate slower than the unrestricted liquid flow in the pipe.

* * * * *